US010403192B2

(12) United States Patent
Albrecht et al.

(10) Patent No.: US 10,403,192 B2
(45) Date of Patent: Sep. 3, 2019

(54) DITHERING TECHNIQUES FOR ELECTRONIC DISPLAYS

(71) Applicant: APPLE INC., Cupertino, CA (US)

(72) Inventors: Marc Albrecht, San Francisco, CA (US); Mahesh B. Chappalli, San Jose, CA (US); Christopher P. Tann, San Jose, CA (US); Jim C. Chou, San Jose, CA (US); Guy Cote, San Jose, CA (US)

(73) Assignee: Apple Inc., Cupertino, CA (US)

( * ) Notice: Subject to any disclaimer, the term of this patent is extended or adjusted under 35 U.S.C. 154(b) by 67 days.

(21) Appl. No.: 15/655,591

(22) Filed: Jul. 20, 2017

(65) Prior Publication Data

US 2018/0082626 A1 Mar. 22, 2018

Related U.S. Application Data

(60) Provisional application No. 62/398,411, filed on Sep. 22, 2016.

(51) Int. Cl.

| | |
|---|---|
| ***G09G 3/20*** | (2006.01) |
| ***G09G 3/32*** | (2016.01) |
| ***G09G 3/36*** | (2006.01) |
| ***G09G 3/3208*** | (2016.01) |

(52) U.S. Cl.

CPC ..... *G09G 3/2055* (2013.01); *G09G 3/3208* (2013.01); *G09G 3/3607* (2013.01); *G09G 3/3614* (2013.01); *G09G 3/2003* (2013.01); *G09G 3/2051* (2013.01); *G09G 3/2059* (2013.01); *G09G 2300/0452* (2013.01); *G09G 2320/0242* (2013.01); *G09G 2320/0257* (2013.01)

(58) Field of Classification Search

USPC ..... 345/598

See application file for complete search history.

(56) References Cited

U.S. PATENT DOCUMENTS

| | | | | |
|---|---|---|---|---|
| 6,982,722 | B1 * | 1/2006 | Alben | G09G 3/2048 345/596 |
| 7,190,380 | B2 | 3/2007 | Damera-Venkata et al. | |
| 7,352,373 | B2 | 4/2008 | Feng et al. | |
| 7,692,665 | B2 | 4/2010 | Daly et al. | |
| 8,451,289 | B2 | 5/2013 | Feng et al. | |
| 2005/0185746 | A1 * | 8/2005 | Jung | H02M 3/07 375/374 |
| 2010/0295866 | A1 * | 11/2010 | Ishii | H04N 9/3111 345/597 |

(Continued)

*Primary Examiner* — Wesner Sajous

(74) *Attorney, Agent, or Firm* — Fletcher Yoder, P.C.

(57) ABSTRACT

Devices and methods for error diffusion and spatiotemporal dithering are provided. By way of example, a method of operating a display includes receiving a pixel input, a set of pixel coordinates, and a current frame number. A kernel and a particular kernel bit of the kernel is selected from a set of kernels, based upon the pixel input, the pixel coordinates, the frame number, or any combination thereof. A dithered output is determined based at least in part upon the kernel bit. When the display is in a diamond pixel configuration, the dithered output is applied in accordance with a diamond pattern formed by red, blue, or red and blue pixel channels.

20 Claims, 11 Drawing Sheets

(56) References Cited

U.S. PATENT DOCUMENTS

| | | | | |
|---|---|---|---|---|
| 2011/0285746 | A1* | 11/2011 | Swic | G09G 5/02 345/597 |
| 2014/0247289 | A1* | 9/2014 | Park | G09G 3/2055 345/690 |
| 2015/0279319 | A1* | 10/2015 | Zhu | G09G 5/02 345/694 |
| 2015/0379674 | A1* | 12/2015 | Golas | G06T 1/60 345/426 |
| 2016/0260387 | A1 | 9/2016 | Albrecht et al. | |
| 2017/0358255 | A1* | 12/2017 | Wang | G09G 3/2055 |

* cited by examiner

| | PIXEL 0 | PIXEL 1 | PIXEL 2 | PIXEL 3 | PIXEL 4 | PIXEL 5 | PIXEL 6 | PIXEL 7 | PIXEL 8 | PIXEL 9 | PIXEL 10 | PIXEL 11 |
|---|---|---|---|---|---|---|---|---|---|---|---|---|
| LINE 0 | (0,0) | | (1,1) | | (2,2) | | (3,3) | | (0,0) | | (1,1) | |
| LINE 1 | | (0,1) | | (1,2) | | (2,3) | | (3,0) | | (0,1) | | (1,2) |
| LINE 2 | (3,1) | | (0,2) | | (1,3) | | (2,0) | | (3,1) | | (0,2) | |
| LINE 3 | | (3,2) | | (0,3) | | (1,0) | | (2,1) | | (3,2) | | (0,3) |
| LINE 4 | (2,2) | | (3,3) | | (0,0) | | (1,1) | | (2,2) | | (3,3) | |
| LINE 5 | | (2,3) | | (3,0) | | (0,1) | | (1,2) | | (2,3) | | (3,0) |
| LINE 6 | (1,3) | | (2,0) | | (3,1) | | (0,2) | | (1,3) | | (2,0) | |
| LINE 7 | | (1,0) | | (2,1) | | (3,2) | | (0,3) | | (1,0) | | (2,1) |

*FIG. 14*

DITHERING TECHNIQUES FOR ELECTRONIC DISPLAYS

CROSS REFERENCE TO RELATED APPLICATIONS

This application is a Non-Provisional Patent Application of U.S. Provisional Patent Application No. 62/398,411, entitled "Dithering Techniques for Electronic Displays", filed Sep. 22, 2016, which is herein incorporated by reference in its entirety and for all purposes.

BACKGROUND

The present disclosure relates generally to dithering, and more particularly, to error diffusion and spatiotemporal dithering in electronic displays.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays (e.g., liquid crystal displays (LCDs)) are commonly used as screens or displays for a wide variety of electronic devices, including such consumer electronics as televisions, computers, and handheld devices (e.g., cellular telephones, audio and video players, gaming systems, and so forth). Such display devices typically provide a flat display in a relatively thin and low weight package that is suitable for use in in a variety of electronic goods. In addition, such display devices typically use less power than comparable display technologies, making them suitable for use in battery powered devices or in other contexts where it is desirable to minimize power usage.

Display devices typically include thousands (e.g., or millions) of picture elements, e.g., pixels, arranged in rows and columns. For any given pixel of a display device, the amount of light that viewable on the display depends on the voltage applied to the pixel. However, applying a single direct current (e.g., DC) voltage could eventually damage the pixels of the display. Thus, to prevent such possible damage, display devices typically alternate, or invert, the voltage applied to the pixels between positive and negative DC values for each pixel.

To display a given color at a given pixel, the display device may receive a set of bits of image data, whereby portions of the set of bits of data correspond to each of the pixel colors. However, as the transition time for these displays have increased, pixels may not transition to a new color rapidly enough, which may lead to an undesired effect on the image termed "motion blurring." To minimize this motion blurring, response times of the display devices may be increased. One manner in which to improve response times of the display devices may include reducing a portion size of data corresponding to each of the primary colors.

The reduction of data bits corresponding to colors may allow the pixels of the display device to transition from one level to another more rapidly, however, it may also reduce the number of levels (e.g., colors) that each pixel may be able to render. To overcome this reduction in levels, dithering of the pixels may be performed. Dithering of the pixels may include applying slightly varying shades of color in a group of adjacent pixels to "trick" the human eye into perceiving the desired color, despite the fact that none of the pixels may be actually displaying the desired color.

The use of dithering may allow display devices that receive lower-bit color data to simulate colors achievable by higher-bit color data display devices. However, use of dithering may, in combination with the display device inversion techniques discussed above, lead to generation of visible artifacts on the display device. It may be useful to provide more advanced and improved image dithering techniques.

SUMMARY

Certain aspects commensurate with certain disclosed embodiments are set forth below. It should be understood that these aspects are presented merely to provide the reader with a brief summary of the disclosure and that these aspects are not intended to limit the scope of the disclosure or the claims. Indeed, the disclosure and claims may encompass a variety of aspects that may not be set forth below.

Devices and methods for reducing or eliminating spatiotemporal dithering image artifacts are provided. By way of example, a method includes providing positive polarity and negative polarity data signals to a plurality of pixels of a display during a first frame period, in which the first frame period corresponds a first spatiotemporal rotation phase. The method includes providing the positive polarity signals and the negative polarity signals to the plurality of pixels of the display during a second frame period, in which the second frame period corresponds a second spatiotemporal rotation phase. A spatiotemporal rotation phase sequence provided to the display comprises the first spatiotemporal rotation phase and the second spatiotemporal rotation phase. One of the first spatiotemporal rotation phase and the second spatiotemporal rotation phase of the spatiotemporal rotation phase sequence is altered during the first frame period or the second time period.

BRIEF DESCRIPTION OF THE DRAWINGS

Advantages of the disclosure may become apparent upon reading the following detailed description and upon reference to the drawings in which:

FIG. 14 is a diagram of a dither matrix for a Gr/Gb pixel configuration, using a second technique, in accordance with an embodiment.

DETAILED DESCRIPTION

Figure 1:
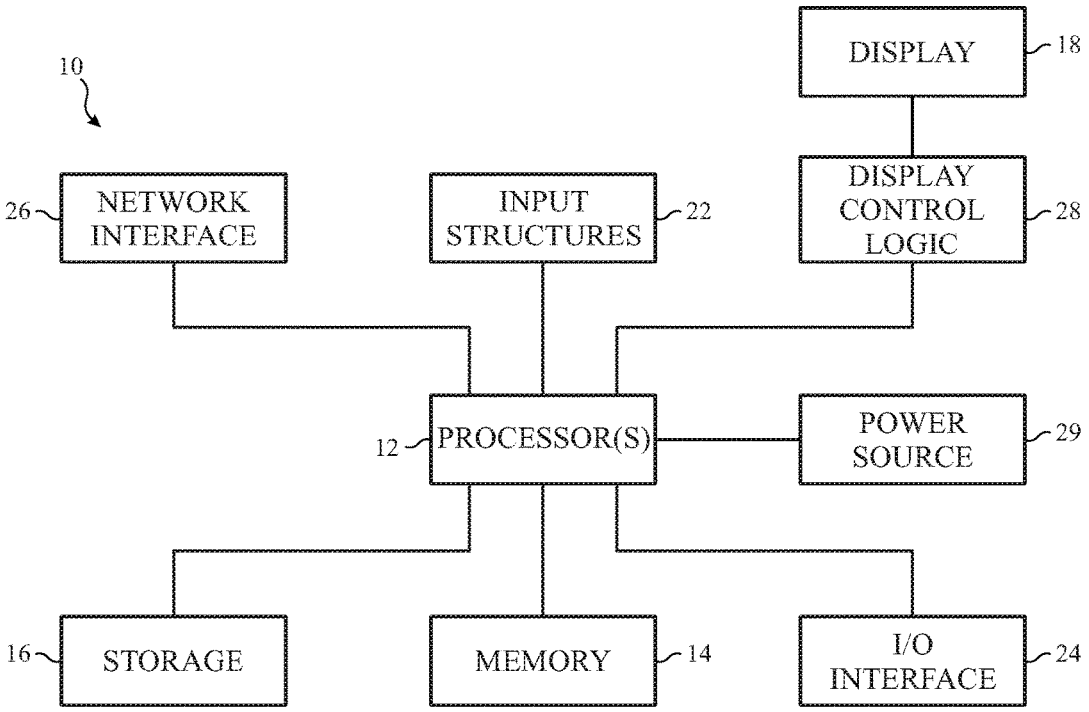
FIG. 1 is a schematic block diagram of an electronic device including display control circuitry, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure generally relate to spatiotemporal dithering and methods for reducing and/or substantially eliminating voltage or pixel charge imbalance, and, by extension, image artifacts that may be caused by spatiotemporal dithering. In certain embodiments, a graphics processor it may be used to periodically and/or aperiodically skip or alter one or more spatiotemporal dithering patterns or phases of a sequence of spatiotemporal patterns or phases corresponding to each frame of data stored to the pixels of a display. Specifically, sporadically (e.g., periodically or aperiodically) skipping or altering one or more spatiotemporal dithering patterns or phases of a predetermined sequence of spatiotemporal patterns or phases when driving the pixels of the display may reduce and/or substantially eliminate voltage and/or charge imbalance of the pixels of the display. Indeed, in some embodiments, the graphics processor may include a counter that is incremented with each frame of a data provided to the pixels of until a predetermined (e.g., static) or configurable (e.g., variable) charge threshold on the individual pixels of the display is reached. Once the pixel charge threshold is reached, the graphics processor may skip one or more spatiotemporal patterns or phases in the sequence or alter the sequence of the one or more spatiotemporal patterns or phases based on the pixel charge.

In some other embodiments, the graphics processor may include a timer that tracks the number of frames provided to the pixels of the display per unit time, and may be used to skip a frame or alter the sequence of spatiotemporal patterns or phases provided to the pixels of the display a number of times per unit time (e.g., skip a spatiotemporal phase or alter the sequence of spatiotemporal phases once or twice per minute). Still, in some other embodiments, the graphics processor may measure and monitor the pixel charge (e.g., monitor how closely the real-time pixel charge is approaching the configurable thresholds), and may skip a spatiotemporal phase or alter the sequence of spatiotemporal phases provided to the pixels of the display when the pixel charge approaches a pixel charge value less than a positive polarity pixel charge threshold value or greater than a negative polarity pixel charge threshold value. Specifically, the graphics processor may randomize the pixel charge threshold for which the skipping or alteration of the sequence of spatiotemporal phases may take place. In this way, the presently disclosed techniques may prevent the pixel charge from exceeding the physical charge characteristics of the pixels, and instead be limited to a nominal pixel charge value (e.g., pixel charge value within the operational characteristic bounds of the pixels). This may thus reduce and/or substantially eliminate voltage and/or charge imbalance of the pixels of the display, and, by extension, reduce and/or substantially eliminate image artifacts based thereon that may become apparent on the display.

With these features in mind, a general description of suitable electronic devices useful in reducing and/or substantially eliminating voltage or pixel charge imbalance due to spatiotemporal dithering is provided. Turning first to FIG. 1, an electronic device 10 according to an embodiment of the present disclosure may include, among other things, one or more processor(s) 12, memory 14, nonvolatile storage 16, a display 18 input structures 22, an input/output (e.g., I/O) interface 24, network interfaces 26, display control logic 28, and a power source 29. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

Figure 2:
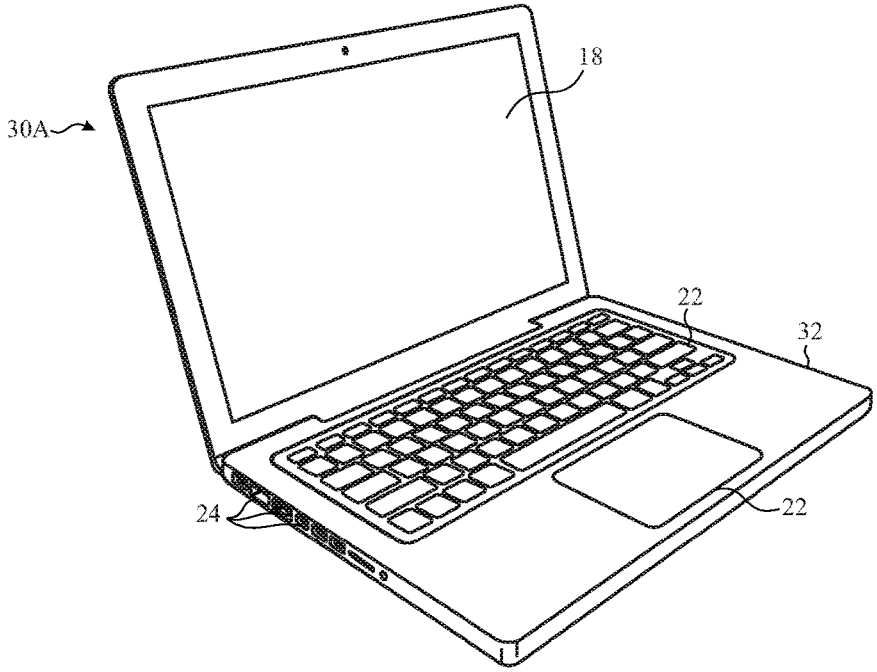
FIG. 2 is a perspective view of a notebook computer representing an embodiment of the electronic device of FIG. 1, in accordance with an embodiment.
Figure 3:
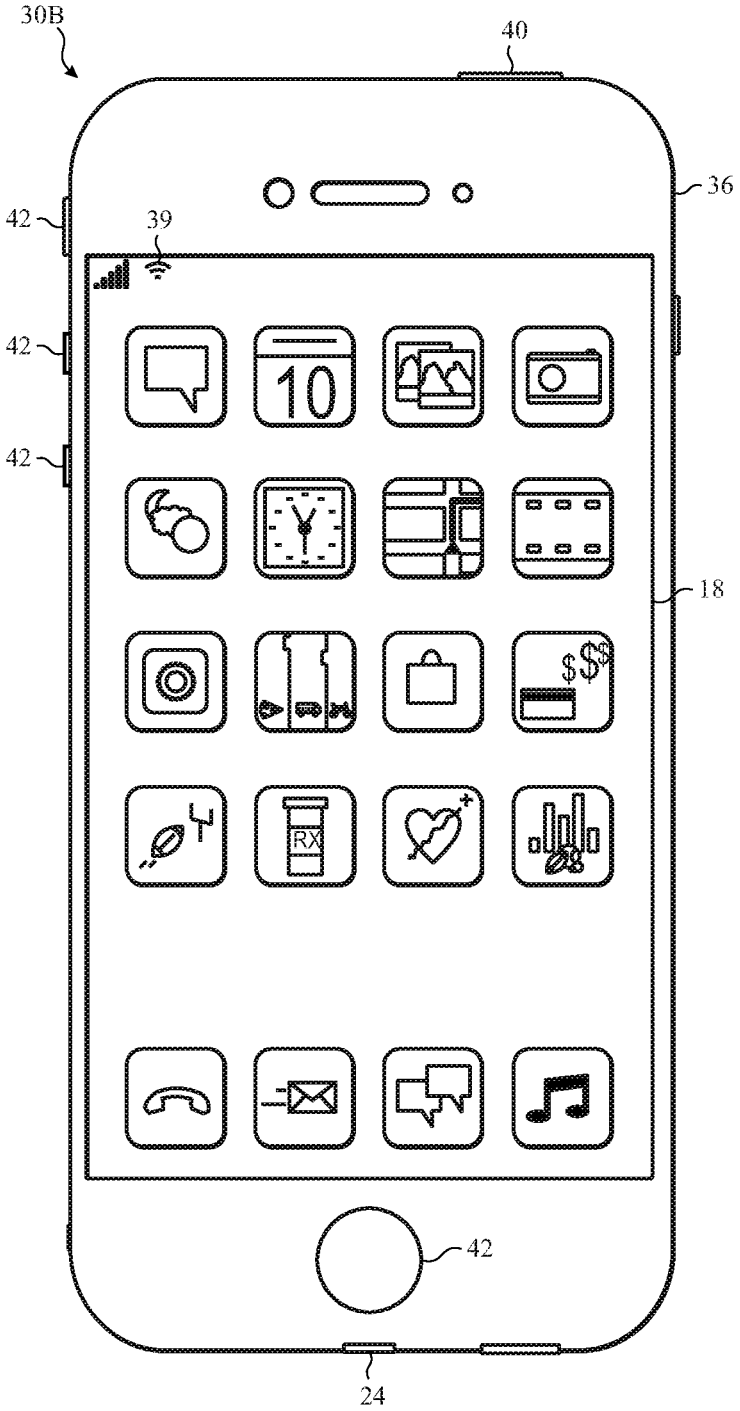
FIG. 3 is a front view of a hand-held device representing another embodiment of the electronic device of FIG. 1, in accordance with an embodiment.
Figure 4:
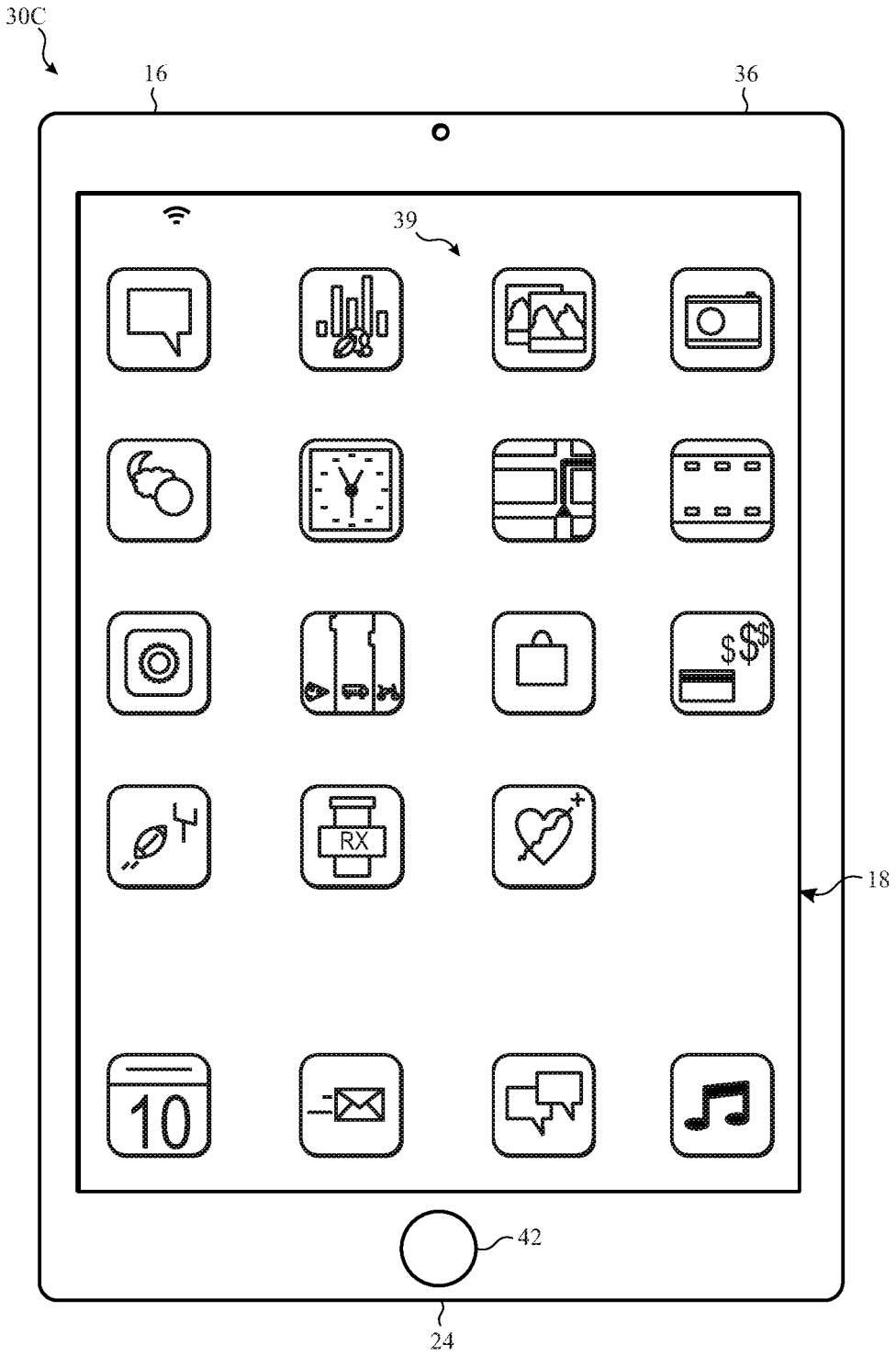
FIG. 4 is a front view of another hand-held device representing another embodiment of the electronic device of FIG. 1, in accordance with an embodiment.
Figure 5:
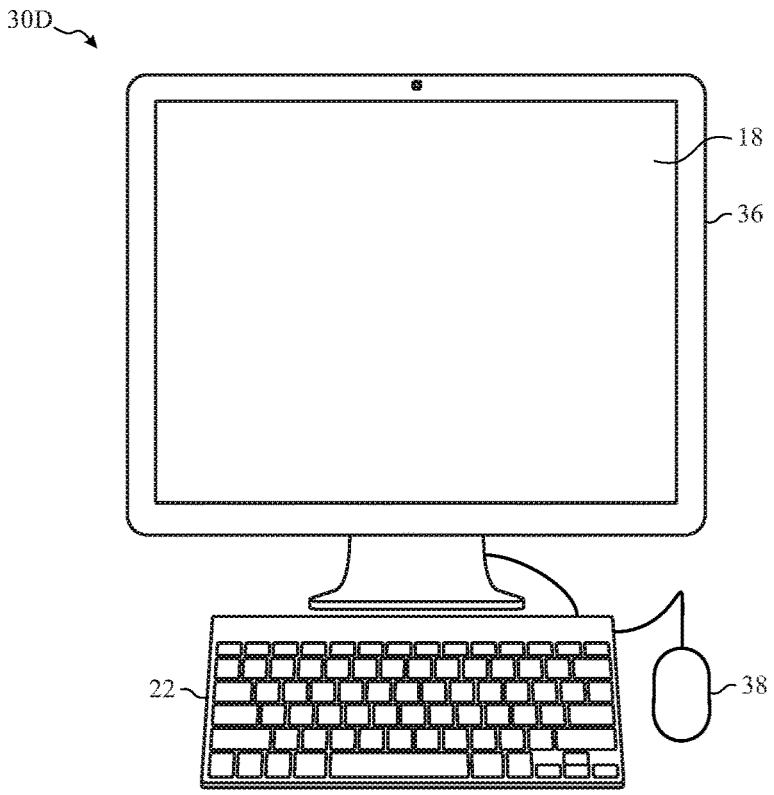
FIG. 5 is a front view of a desktop computer representing another embodiment of the electronic device of FIG. 1, in accordance with an embodiment.
Figure 6:
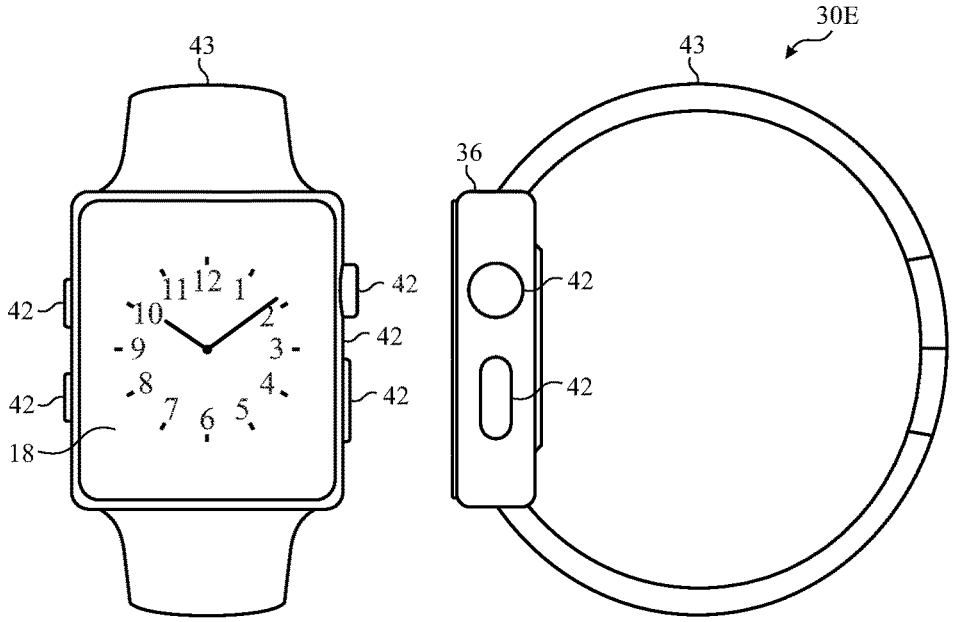
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in either of FIG. 3 or FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile storage 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12 to enable the electronic device 10 to provide various functionalities.

In certain embodiments, the display 18 may be a liquid crystal display (e.g., LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (e.g., OLED) displays, or some combination of LCD panels and OLED panels.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (e.g., PAN), such as a Bluetooth network, for a local area network (e.g., LAN) or wireless local area network (e.g., WLAN), such as an 802.11x Wi-Fi network, and/or for a wide area network (e.g., WAN), such as a 3rd generation (e.g., 3G) cellular network, 4th generation (e.g., 4G) cellular network, or long term evolution (e.g., LTE) cellular network. The network interface 26 may also include interfaces for, for example, broadband fixed wireless access access networks (e.g., WiMAX), mobile broadband Wireless networks (e.g., mobile WiMAX), and so forth. As further illustrated, the electronic device 10 may include a power source 29. The power source 29 may include any suitable source of power, such as a rechargeable lithium polymer (e.g., Li-poly) battery and/or an alternating current (e.g., AC) power converter.

The internal components may further include display control logic 28. The display control logic 28 may be coupled to display 18 and to processor(s) 12. The display control logic 28 may be used to receive a data stream, for example, from processor(s) 12, indicative of an image to be represented on display 18. The display control logic 28 may be an application specific integrated circuit (e.g., ASIC), or any other circuitry for adjusting image data and/or generate images on display 18.

For example, in certain embodiments, the display control logic 28 may receive a data stream equivalent to 24 bits of data for each pixel of display 18, with 8-bits of the data stream corresponding to a level for each of the primary colors of red, blue, and green for each sub-pixel. The display control logic 28 may operate to convert these 24 bits of data for each pixel of display 18 to 18-bits of data for each pixel of display 18, that is, 6-bits of the data stream corresponding to a level for each of the primary colors of red, blue, and green for each sub-pixel. This conversion may, for example, include removal of the two least significant bits of each of the 8-bits of the data stream corresponding to a level for each of the primary colors of red, blue, and green. Alternatively, the conversion may, for example, include a look-up table or other means for determining which 6-bit data value should correspond to each 8-bit data input.

In certain embodiments, the electronic device 10 may take the form of a computer, a portable electronic device, a wearable electronic device, or other type of electronic device. Such computers may include computers that are generally portable (e.g., such as laptop, notebook, and tablet computers) as well as computers that are generally used in one place (e.g., such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of an I/O interface 24. In one embodiment, the input structures 22 (e.g., such as a keyboard and/or touchpad) may be used to interact with the computer 30A, such as to start, control, or operate a graphical-user-interface (GUI) or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (e.g., USB), or other similar connector and protocol.

User input structures 40 and 42, in combination with the display 18, may allow a user to control the handheld device 30B. For example, the input structure 40 may activate or deactivate the handheld device 30B, one of the input structures 42 may navigate user interface to a home screen, a user-configurable application screen, and/or activate a voice-recognition feature of the handheld device 30B, while other of the input structures 42 may provide volume control, or may toggle between vibrate and ring modes. Additional input structures 42 may also include a microphone may obtain a user's voice for various voice-related features, and a speaker to allow for audio playback and/or certain phone capabilities. The input structures 42 may also include a headphone input to provide a connection to external speakers and/or headphones.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (e.g., PC) by another manufacturer. A similar enclosure 36 may be provided to protect and enclose internal components of the computer 30D such as the dual-layer display 18. In certain embodiments, a user of the computer 30D may interact with the computer 30D using various peripheral input devices, such as input structures 22 (e.g., the keyboard or mouse 38), which may connect to the computer 30D via a wired and/or wireless I/O interface 24.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen (e.g., LCD, OLED display, active-matrix organic light emitting diode (e.g., AMOLED) display, and so forth), which may allow users to interact with a user interface of the wearable electronic device 30E.

Figure 7:
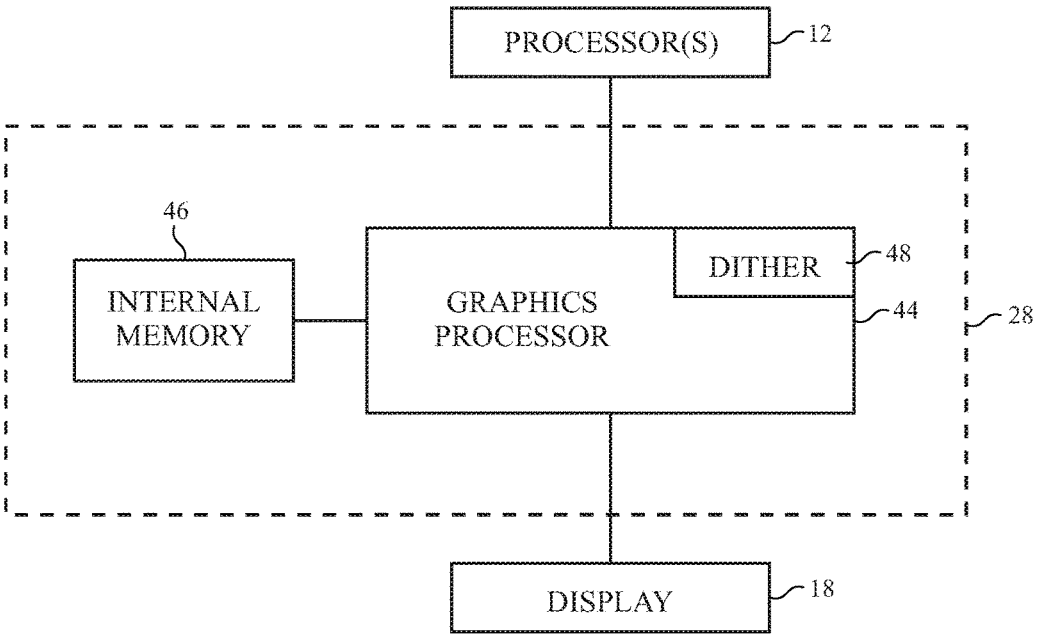
FIG. 7 is a block diagram illustrating components of display control circuitry of FIG. 1, in accordance with one embodiment.

FIG. 7 illustrates components of display control logic 28 of FIG. 1 in accordance with one or more embodiments. As illustrated, display control logic 28 may be positioned between processor(s) 12 and display 18. The display control logic 28 may include graphics processor 44 that may operate to generate images on display 18 of electronic device 10. The graphics processor 44 may be a device that receives pixel intensity levels from processor(s) 12 and may transmit signals corresponding to those pixel intensity levels to display 18. As set forth above, the received pixel intensity levels, e.g. an image code from processor(s) 12, may be a 24-bit data stream and the transmitted voltage levels, e.g., an image code for display on display 18, may correspond to an 18-bit data stream (e.g., when, for example, LCD is a 6-bit display). The pixel intensity levels transmitted to display 18 may be, for example, numerical levels that correspond to respective pixel intensities to be shown on display 18. The display 18 may thus receive the voltage signals from graphics processor 44 as input signals, and may produce an image corresponding to the received voltage signals. The manner in which an image is produced as described below.

In certain embodiments, the graphics processor 44 may, for example, utilize internal memory 46 in performing the functions required by display control logic 28. One of the functions of internal memory 46 may be the storage of a look-up table utilized by graphics processor 44 to convert the received data stream (e.g., 24-bit) into a data stream (e.g., 18-bit) for display on the display 18 (e.g., 6-bit). Another function of internal memory 46 may be to store an algorithm corresponding to a dithering technique to be performed by graphics processor 44. This algorithm may allow for the dithering of the pixels of display 18. For example, the dithering algorithm may be computer code adapted to be stored in internal memory 46 and to be operated on by graphics processor 44 to illuminate a small grouping of pixels, such as four pixels, with slightly varying shades of color that "trick" the human eye into perceiving the desired color, despite the fact that the small group of pixels may not be actually displaying the desired color.

In certain embodiments, the graphics processor 44 may include dithering circuitry 48, or dithering circuitry 48 may be located external to graphics processor 44 either in or outside of display control logic 28. The dithering circuitry 48 may be used to perform dithering of the pixels in display 18 in a manner substantially similar to that described above.

Figure 8:
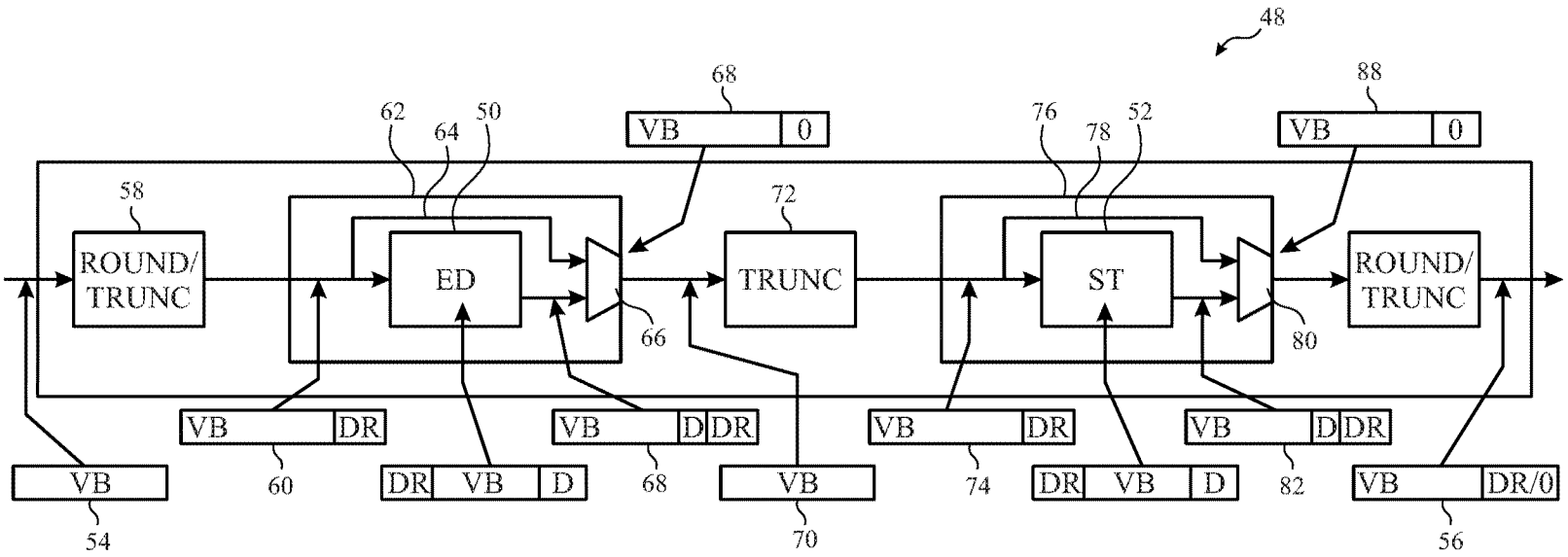
FIG. 8 is a diagram of dithering logic, in accordance with an embodiment.

FIG. 8 illustrates one embodiment of the dithering circuitry 48. As illustrated, the dithering circuitry 48 may provide error diffusion (ED) dithering circuitry 50. Furthermore, in certain embodiments, the dithering circuitry 48 of the graphics processor 44 may perform spatiotemporal dithering via spatiotemporal (ST) dithering circuitry 52.

To perform the ED dithering, the dithering circuitry may receive a set of input bits 54, which represent the input pixel values. In some embodiments, the input bits 54 may be 14-bit values. The dithering circuitry 48 may reduce the number of bits in the output bits 56 (e.g., from 14-bit values to 12, 10 or 8-bit values). For example, the dithering circuitry 48 may use least-significant-bit (LSb) truncation and/or rounding, ED dithering and/or ST dithering. In one embodiment, ED dithering may result in a 2-bit dither (e.g., for the dithered most-significant-bit (MSb). Further, in one embodiment, the ST dithering may result in 2 or 4-bit dithering (e.g., for the remaining dithered bits). Additionally and/or alternatively, the input bits 54 may be truncated and/or rounded (e.g., from 14-bit to 12-bit or 10-bit to 8-bit).

For example, as illustrated in the FIG. 8, rounding and/or truncation logic 58 may be used to round and/or truncate the input buts 54. Thus, as illustrated, resultant bits 60 may include valid bits "VB" and depth reduced bits "DR". These resultant bits 60 are then passed to ED dithering logic 62.

In the ED dithering logic 62, the resultant bits 60 may either be processed by the ED dithering circuitry 50 or bypass the ED dithering circuitry 50 via the bypass 64. In one embodiment, a multiplexer 66 determines which of these two options is used.

When the resultant bits 60 are processed by the ED dithering circuitry 50, the resultant bits of the ED dithering logic 62 (the "ED output 68") will include valid bits "VB", dithered bits "D", and depth reduced bits "DR," as illustrated. In contrast, when the ED dithering circuitry 50 is bypassed, the ED output 68 will include valid bits "VB" and zero bits "0".

The ED output 68 may be provided as an ST dithering input 70, which may include valid bits "VB". The ST dithering input 70 may be truncated by truncation logic 72, resulting in a truncated ST input 74, which may include valid bits "VB" and depth reduced bits "DR," as a result of the truncation. The truncated ST input 74 may either be processed by the ST dithering circuitry 52 or bypass the ST dithering circuitry 52 via the bypass 78. In one embodiment, a multiplexer 80 determines which of these two options is used.

When the ST dithering input 70 is processed by the ST dithering circuitry 52, the resultant bits of the ST dithering logic 76 (the "ST output 82") will include valid bits "VB", dithered bits "D", and depth reduced bits "DR," as illustrated. In contrast, when the ST dithering circuitry 52 is bypassed, the ST output 68 will include valid bits "VB" and zero bits "0".

Thus, the dithering circuitry 48 may output a bit-reduced number of output bits 56. The reduced number of bits may be due to rounding, truncation, ED dithering and/or ST dithering.

Error Diffusion Dithering

Figure 9A:
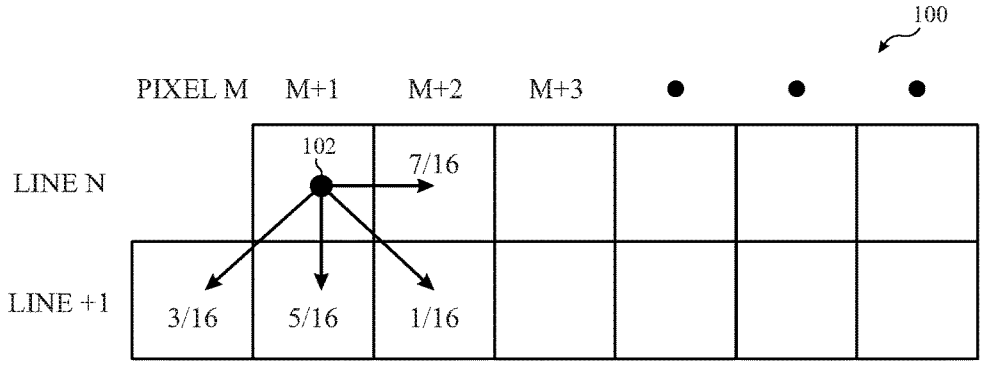
FIG. 9A illustrates error diffusion dithering for an RGB pixel configuration, in accordance with an embodiment.
Figure 9B:
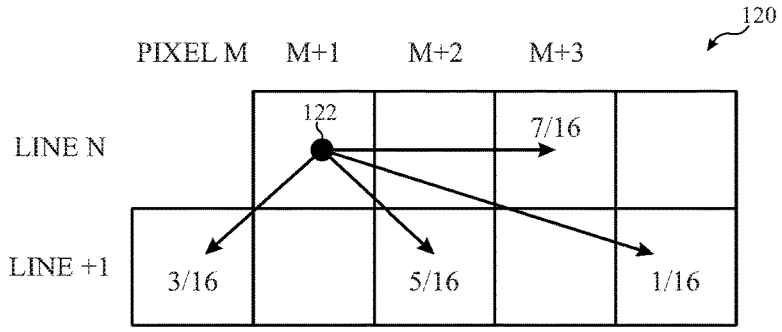
FIG. 9B illustrates error diffusion dithering for a Gr/Gb pixel configuration, in accordance with an embodiment.

Turning now to a more detailed discussion of ED dithering, FIGS. 9A and 9B illustrate embodiments of Floyd-Steinberg Error Diffusion. FIG. 9A illustrates ED dithering for pixels arranged in a red-green-blue (RGB) arrangement and FIG. 9B illustrates ED dithering for pixels arranged in a Gr/Gb arrangement. Error diffusion dithering works by distributing residual error of a pixel. For example, the Floyd-Steinberg dithering algorithm achieves dithering by distributing (e.g., adding) any residual error of a pixel onto neighboring pixels. Accordingly, the error is diffused.

i. Error Diffusion Dithering with RGB Pixel Arrangement

The distribution of the error may differ depending on the arrangement of the pixels in the display 18. For example, FIG. 9A illustrates residual error distribution 100 for a display arranged in a Red (R), Green (G), Blue (B) or RGB pattern.

The residual error value is determined by comparing a pixel's value with a programmable threshold per color component. In some embodiments, this programmable threshold is set to a default value of 0.5. As illustrated in FIG. 9A, the error is distributed to the right and below (e.g., below-left, below-right, and immediately below) the current pixel 102.

Below is pseudocode that represents an embodiment for implementing Floyd-Steinberg dithering for a RGB pixel arrangement:

```
Array Error[2][Comp][W] = 0 -- Define 2 line buffer for errors
Pixel(X, Y) in (W, H)
foreach L = 0
foreach Comp in (R, G, B)
    Val = Pixel + Error[L][Comp][X];
    if Val > THRESHOLD then
        PixelOut = ((Val >> NUM_OF_BITS_REDUCED)+1)<<
NUM_OF_BITS_REDUCED
    else
        PixelOut = (Val >> NUM_OF_BITS_REDUCED)<<
NUM_OF_BITS_REDUCED
    Error = Val - PixelOut
    Error[L][Comp][X+1] = Error*7/16 -- Error for next pixel
    Error[~L][Comp][X-1] += Error*3/16 -- Lower Left Pixel
    Error[~L][Comp][X] += Error*5/16 -- Pixel below
    Error[~L][Comp][X+1] = Error*1/16 -- Lower Right pixel
    L = ~L
end
end
```

ii. Error Diffusion Dithering with Gr/Gb Pixel Arrangement

It may be beneficial to modify the error distribution when alternative pixel arrangements are present. For example, in contrast to an RGB arrangement, where each pixel consists of an RGB triplet, in a Gr/Gb arrangement, each pixel consists of Gr pair or a Gb pair. Thus, in a Gr/Gb arrangement, during ED dithering, the R and B sub-pixels arrive at half the rate of the G sub-pixels. Because the color distribution with a Gr/Gb arrangement is different than in an RGB arrangement, it may be beneficial to alter the dithering techniques.

In one embodiment, the dithering circuitry 48 may receive an indication of a particular arrangement of pixels (e.g., RGB or Gr/Gb) and alter the ED dithering and/or ST dithering based upon the indication. For example, if the indication indicates that the arrangement of pixels is an RGB arrangement, the ED dithering may be performed in accordance with the discussion of the section "Error Diffusion Dithering with RGB Pixel Arrangement." In contrast, when the indication indicates that the pixel arrangement is a Gr/Gb arrangement, the ED dithering may be performed in accordance with the discussion of the section "Error Diffusion Dithering with Gr/Gb Pixel Arrangement."

FIG. 9B illustrates an alternative Floyd-Steinberg dithering distribution 120 that may be used when the display 18 uses a Gr/Gb pixel arrangement. For example, as illustrated in the distribution 120, due to the half-rate nature of the R and B channels, the ED dither circuitry 50 may spread the current pixel 122 error distribution for the R and B channels over a wider area than is done with RGB arrangements (e.g., as illustrated in FIG. 9A). Because the G sub-pixels arrive at the same rate, the error for the green channel is distributed in accordance with the discussion of FIG. 9A. As may be appreciated, the diamond layout of the R and B sub-pixels results in a less symmetrical distribution than the G sub-pixels. For example, as illustrated in FIG. 9B, the error for the current pixel 122 may be distributed to the nearest pixel having the same color component (e.g., the next Gr pixel for red and/or the next Gb pixel for blue), as illustrated in FIG. 9B.

Below is pseudocode that represents an embodiment for implementing Floyd-Steinberg dithering for red and blue channels in a display having a Gr/Gb pixel arrangement:

```
Array Error[2][Comp][W] = 0 -- Define 2 line buffer for errors
L = 0
foreach Pixel(X, Y) in (W, H)
    if (pixtype = GR)
        subpix = Red
    Else
        subpix = Blue
    Val = Pixel + Error[L][Comp][X];
    if Val > THRESHOLD then
        PixelOut(subpix) = ((Val >>
        NUM_OF_BITS_REDUCED)+1)<<
NUM_OF_BITS_REDUCED
    else
        PixelOut(subpix) = (Val >> NUM_OF_BITS_REDUCED)<<
NUM_OF_BITS_REDUCED
    Error = Val - PixelOut(subpix)
    Error[L][Comp][X+2] = Error*7/16 -- Error for next pixel
    Error[~L][Comp][X-1] += Error*3/16 -- Lower Left Pixel
    Error[~L][Comp][X+1] += Error*5/16 -- Lower Right Pixel below
    Error[~L][Comp][X+3] = Error*1/16 -- Second Lower Right Pixel
    L = ~L
end
end
```

Spatial Temporal Dithering

Figure 10:
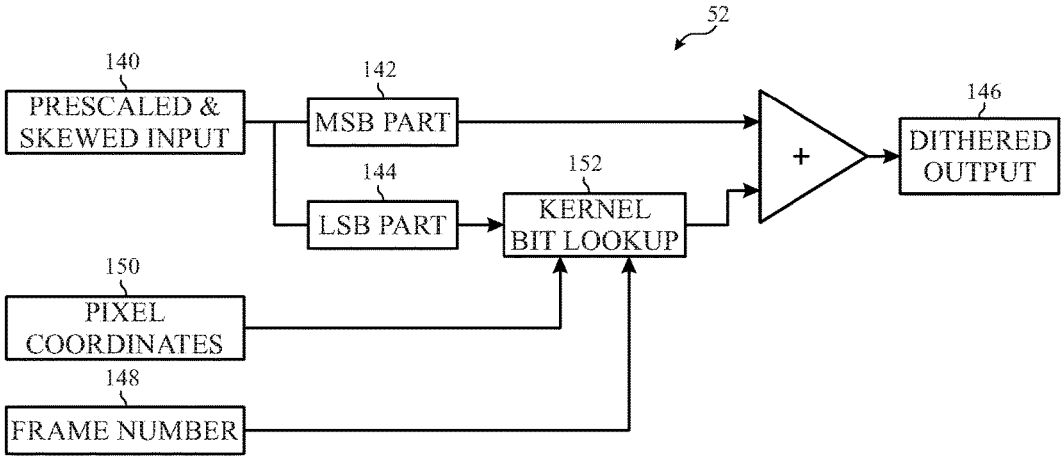
FIG. 10 is a diagram of spatiotemporal dithering logic, in accordance with an embodiment.

Turning now to a more detailed discussion of spatiotemporal (ST) dithering, FIG. 10 illustrates an embodiment of ST dithering circuitry 52. When high-precision pixel data is provided for presentation on a lower-precision display, quantization errors may occur. The ST dithering circuitry 52 distributes this quantization error spatially and temporally, such that the resulting image simulates presentation on a high-precision display. In some embodiments, the ST dithering circuitry 52 may precondition ST input pixel data 140. For example, as illustrated, ST input pixel data 140 may be pre-scaled and/or skewed.

Pre-scaling involves truncating 0 or more LSb from the ST input pixel data 140. For example, when it is desirable to use dithering to reduce a number of bits from 10-bits to 8-bits, 1 bit can be truncated and 9-bits of data may be dithered to 9-bits of data. Alternatively, the 10-bit data may be dithered to 8-bits without truncation or 2-bits may be truncated, resulting in 8-bits of data.

The ST input pixel data 140 may additionally and/or alternatively be skewed. Skewing is a process where the ST input pixel value range is reduced to fit the output levels. Certain levels in the input data may not be reproduced via dithering. For example, when 10-bit pixels (e.g., having grey levels of 0 to 1023) are to be displayed on a 8-bit display panel (e.g., having grey levels 0 to 255), source grey levels 0, 4, 8, . . . , and 1020 are represented by panel grey levels 0, 1, 2, . . . , and 244, respectively. Other source grey levels can be represented by dithering between two panel grey levels, except for source grey levels 1021-1023, as these levels would use dithering between panel grey levels 255 and 256. Because the panel grey level 256 does not exist, these 3 uppermost source levels are clamped at 1020 and, thus, are lost. Skewing adds flexibility to define where grey levels are lost, rather than always losing top levels. Thus, skewing may be used to minimize impact on the image quality. Particular skew locations where grey levels can be lost may be provided, such that the upper range of the input data may be represented by a lower-bit display.

Once the ST input pixel data 140 is pre-scaled and skewed into input 141, it is decompressed into an MSb part 142 and an LSb part 144. The width of the LSb part 144 may be set to bit-width difference between the input 140 and a dithered output 146. The rest of the bits are part of the MSb part 142. The LSb part 144, combined with the current frame number 148, and the pixel coordinates (e.g., X/Y coordinates) 150 of the current pixel, may be used as an index to look up the "Kernel Bit," via Kernel Bit Lookup table 152. The dithered output 146 may either be the input pixel data 140 (when bypassing dithering operations) or may be the MSB part 142 added to the kernel bit.

i. Spatiotemporal Dithering with RGB Pixel Arrangement

Figure 11:
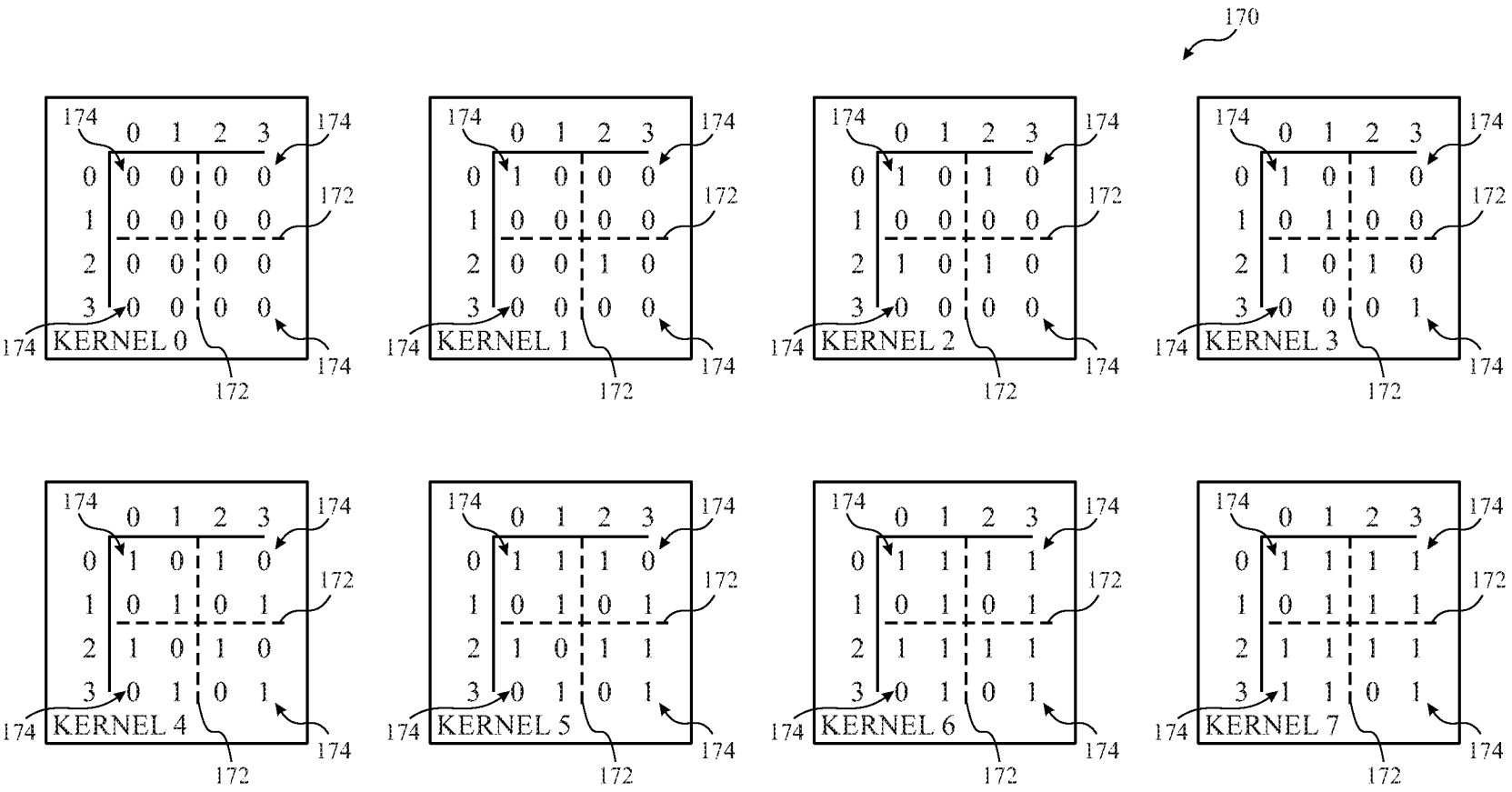
FIG. 11 is a diagram of dithering kernels, in accordance with an embodiment.

Discussing first spatiotemporal dithering for a display with an RGB pixel arrangement, FIG. 11 illustrates a table 170 of 8 kernels (Kernel 0-Kernel 8). Each of the 8 kernels includes a 4×4 matrix of zeros and ones. For each pixel, the LSb part 144 is used to choose one kernel out of the 8 kernels. Further, the pixel coordinates 150 are used to select a particular element within the selected kernel. For example, the 2 LSb bits of the x and y coordinates of the pixel coordinates 150 may be used as horizontal and vertical indices, respectively, to select one element from the chosen kernel.

Figure 12:
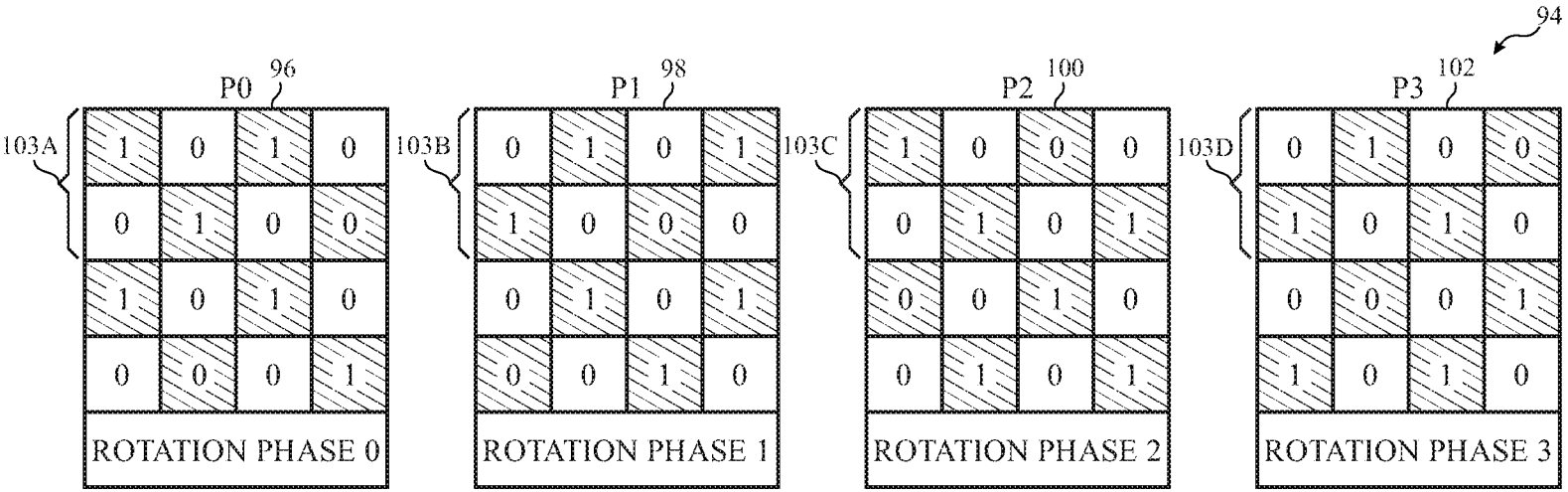
FIG. 12 is a diagram of a phase rotation pattern of kernel 3 of FIG. 11, in accordance with an embodiment.

Each Kernel n has exactly 2*n ones out of 16 elements. Therefore, an example input image, for which the LSb part 144 of every pixel is "n", is dithered correctly when averaged spatially. In addition to this spatial aspect, a temporal aspect is added to the algorithm by rotating the kernels every frame. Each kernel is subdivided (e.g., as illustrated by the dashed sub-division lines 172) into 2×2 sub-kernels 174. Each sub-kernel 174 is rotated 90 degrees clockwise for each successive frame, repeating the rotation sequence every 4 frames. FIG. 12 illustrates an example of this rotation sequence over four frames (P0, P1, P2, and P3) for Kernel 3 of FIG. 11. This kernel rotation results in near-optimal dithering for each pixel location, when averaged over 4 frames. This is true even when examined without the spatial aspect.

Each color channel (RGB) can be set to rotate with a different phase offset, so that the dithering pattern for each color does not overlap with the dithering pattern of another color. Avoiding overlap of dithering patterns reduces the chance of flickers or other dithering artifacts. The R and B channels can have independent rotation phase offsets with respect to the G channel.

The kernel bit patterns and the sequence of rotation phases can be programmed via the use of registers. In some embodiments, it may be useful to tweak these registers for some display panels, because the panel's own flickering pattern may interact with the spatial-temporal dithering, resulting in increased flicker or visible dithering artifacts. For example, for LCD panels employing two-dot inversion, setting the registers in a rotation phase sequence 0→2→1→3 instead of the default sequence 0→1→2→3 may improve the image quality.

ii. Spatiotemporal Dithering with Gr/Gb Pixel Arrangement

When a display uses a Gr/Gb pixel arrangement, the Spatiotemporal dithering process may be altered from the spatiotemporal dithering process of a display using an RGB pixel arrangement, discussed above. In some embodiments, the dithering circuitry 48 may receive an indication of a particular arrangement of pixels (e.g., RGB or Gr/Gb) and alter the ST dithering based upon the indication. For example, if the indication indicates that the arrangement of pixels is an RGB arrangement, the ST dithering may be performed in accordance with the discussion in the section "Spatiotemporal Dithering with RGB Pixel Arrangement" found above. In contrast, when the indication indicates that the pixel arrangement is a Gr/Gb arrangement, the ST dithering may be performed in accordance with the discussion of the section "Spatiotemporal Dithering with Gr/Gb Pixel Arrangement."

As discussed above, the Gr/Gb pixel arrangement results in a square pattern for green sub-pixels and a diamond pattern for red and blue sub-pixels. Accordingly, because the green sub-pixels remain in a square pattern, similar to RGB pixel arrangements, when performing spatiotemporal dithering for a display with a Gr/Gb pixel arrangement, the green sub-pixels may be processed in accordance with the discussion of the section "Spatiotemporal Dithering with RGB Pixel Arrangement."

Thus, for the green channels, for each pixel, the LSb part 144 is used to choose one kernel out of the 8 kernels of FIG. 11. Further, the pixel coordinates 150 are used to select a particular element within the selected kernel. For example, the 2 LSb bits of the x and y coordinates of the pixel coordinates 150 may be used as horizontal and vertical indices, respectively, to select one element from the chosen kernel.

Further, a temporal aspect is added by rotating the kernels every frame. As mentioned above, each kernel is subdivided (e.g., as illustrated by the dashed sub-division lines 172) into 2×2 sub-kernels 174. Each sub-kernel 174 is rotated 90 degrees clockwise for each successive frame, repeating the rotation sequence every 4 frames.

However, because the red and blue sub-pixels are in a diamond pattern, modifications to the spatiotemporal dithering may be warranted. In a first embodiment, illustrated in FIG. 13, the ST dithering process described in the section "Spatiotemporal Dithering with RGB Pixel Arrangement," except that the process is only applied to every other pixel (e.g., the pixels containing the appropriate R or B sub-pixels). In a second embodiment, illustrated in FIG. 14, the ST dithering process may be applied by shifting the dither matrix kernels 45 degrees, resulting in a better pixel layout match. These embodiments are discussed in more detail below.

a. Standard Matrix ST Dither

In this mode, the spatiotemporal dithering process discussed above in the section "Spatiotemporal Dithering with RGB Pixel Arrangement" is applied, but only to every second pixel for the R and B channels (i.e. the pixel that contains the appropriate R or B sub-pixel). Due to the diamond pattern of the R and B sub-pixels, the actual pixel number alternates line to line. For example, if R is processed for every even pixel in line N, it will be processed for every odd pixel in line N+1. In all other respects, this mode follows the standard ST Dither mode discussed above.

Accordingly, instead of the 2 LSb bits of the x and y coordinates being used as horizontal and vertical indices respectively, to select one element from the chosen kernel, as discussed above, for a Gr/Gb pixel arrangement, bits 2:1 of the x coordinate and bits 1:0 of they coordinate are used as horizontal and vertical indices respectively, to select one element from the chosen kernel. FIG. 15 illustrates the dither matrix horizontal and vertical indices for various pixels in this mode. As illustrated, the dither matrix is formed from every other pixel for the red and blue sub-pixels, due the diamond pattern of the R and B sub-pixels.

Figure 13:
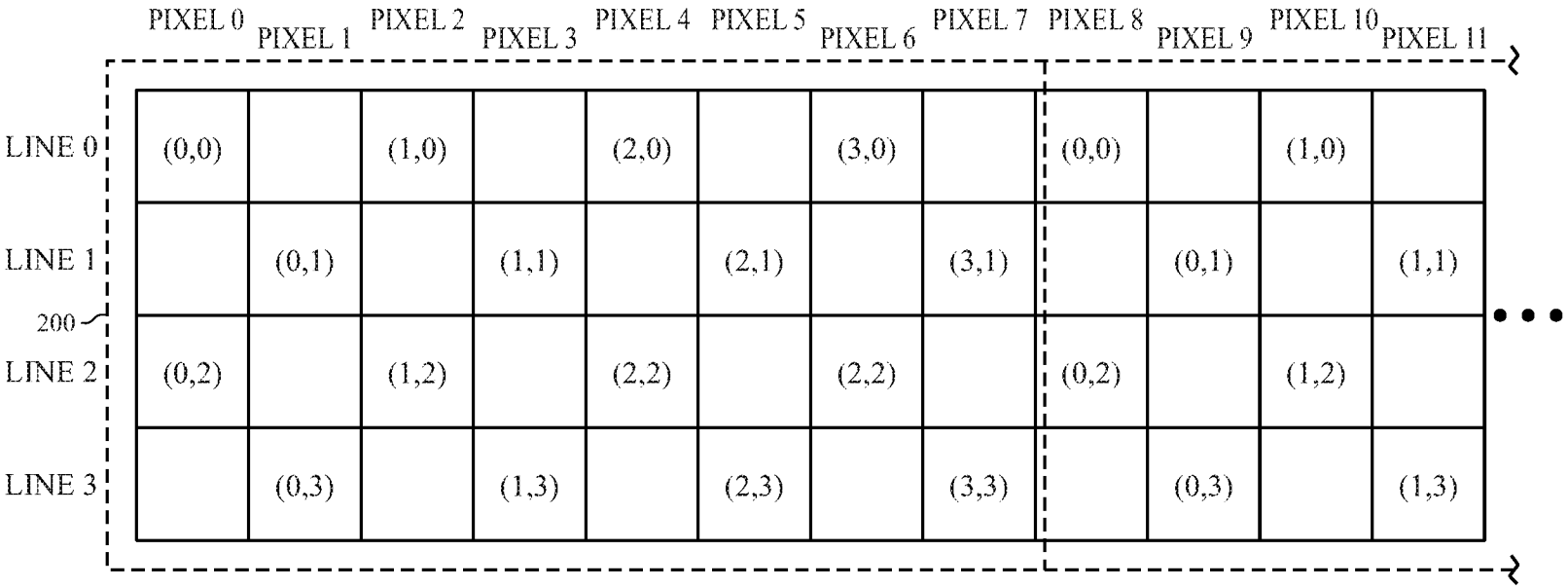
FIG. 13 is a diagram of a dither matrix for a Gr/Gb pixel configuration, using a first technique, in accordance with an embodiment.

As illustrated by box 200 in FIG. 13, the dither kernels (e.g., from FIG. 13) are applied a larger spread than in the RGB configuration. Further, as illustrated, the application of the kernel may be rectangular, rather than square. This is caused by the pixel number alternating from line to line. For example, coordinate (0,1) of the kernel is found at pixel 1 in line 1, because pixel 0 does not contain the appropriate red or blue sub-pixel.

As mentioned above, the kernels are rotated each frame. Accordingly, because the kernel application is a rectangular shape, the ordinary rotation of the kernels may not be optimal. To counter-act the effects of dithering in this rectangularu shape, in certain embodiments, the kernel may be doubled, such that a kernel is applied to another four lines of pixels 0-7. This may result in a more square application b. 45 Degree Rotated ST Dither In a second embodiment, the dithering matrix may be applied at 45 degrees for R and B sub-pixels, in order to better match the pixel layout. FIG. 14 illustrates the dither matrix horizontal and vertical indices for various pixels applied at 45 degrees. Accordingly, in contrast to the above technique where the 2 LSb bits of the x and y coordinates are used as horizontal and vertical indices respectively, to select one element from the chosen kernel, the selection is modified in 45 degree Rotated ST Dither mode (for R and B sub-pixels). In one embodiment, the selection may be modified according to the following pseudo-code:

```
foreach Pixel(X, Y) in (W, H)
    if (pixtype = GR)
        subpix = Red
    Else
        subpix = Blue
    h_index = MOD(X[2:1] − Y[2:1], 4)
    v_index = MOD(Y[2:1] + Y[0] + X[2:1], 4)
end
```

While the various embodiments may be susceptible to various modifications and alternative forms, specific embodiments have been shown by way of example in the drawings and have been described in detail herein. However, it should be understood that that the claims are not intended to be limited to the particular forms disclosed. Rather, the the claims are to cover all modifications, equivalents, and alternatives falling within the spirit and scope of the disclosure.

What is claimed is:

1. A method of operating an electronic display, comprising:

receiving, via one or more processors, a pixel input;

receiving, via the one or more processors, a set of pixel coordinates associated with the pixel input;

receiving, via the one or more processors, a current frame number associated with the pixel input;

selecting, via the one or more processors, a kernel from a kernel lookup table, based upon the pixel input, the pixel coordinates, the frame number, or any combination thereof;

selecting, via the one or more processors, a kernel bit from the kernel, based upon the pixel input, the pixel coordinates, the frame number, or any combination thereof;

calculating, via the one or more processors, a dithered output based at least in part upon the kernel bit; and applying, via the one or more processors, the dithered output to the electronic display in accordance with a diamond pattern formed by red channels, blue channels, or red and blue pixel channels;

wherein the kernel is rotated for a subsequent frame of image data.

2. The method of claim 1, wherein applying the dithered output in accordance with the diamond pattern formed by the red, the blue, or the red channels and the blue pixel channels comprises:

selecting, via the one or more processors, the kernel bit using only every second pixel for the red channels and the blue channels.

3. The method of claim 2, comprising selecting, via the one or more processors, the kernel bit using bits 2:1 of an x-coordinate of the pixel coordinates as a horizontal index and bits 1:0 of a y-coordinate of the pixel coordinates as a vertical index to select the kernel bit from the kernel.

4. The method of claim 2, comprising:

doubling, via the one or more processors, a size of the kernel to counter-act a rectangular diffusion caused by using only every second pixel for the red channels and the blue channels.

5. The method of claim 1, comprising:

receiving, via the one or more processors, an indication of a pixel configuration, the indication selectively configurable between a non-diamond pixel configuration and a diamond pixel configuration;

selecting, via the one or more processors, the kernel bit in a first manner when the indication indicates the non-diamond pixel configuration; and selecting, via the one or more processors, the kernel bit in a second manner when the indication indicates the diamond pixel configuration;

wherein the first manner and the second manner are different.

6. The method of claim 5, wherein the first manner and the second manner both use bits of an x-coordinate of the pixel coordinates as a horizontal index and bits of a y-coordinate of the pixel coordinates as a vertical index to select the kernel bit from the kernel, wherein the bits of the x-coordinate and the bits of the y-coordinate differ between the first manner and the second manner.

7. The method of claim 1, wherein:

a diamond pixel configuration dithering matrix of pixels is oriented 45 degrees from an RGB pixel configuration dithering matrix, wherein the diamond pixel configuration dithering matrix of pixels defines where the dithered output is to be applied.

8. The method of claim 7, comprising selecting the kernel bit at least in part by:

setting, via the one or more processors, a horizontal index equal to (bits [2:1] of an x-coordinate of the pixel input minus bits [2:1] of a y-coordinate of the pixel input) modulo 4;

setting, via the one or more processors, a vertical index equal to (bits [2:1] of the y-coordinate of the pixel input plus bit [0] of the y-coordinate of the pixel input plus bits [2:1] of the x-coordinate of the pixel input) modulo 4; and looking up, via the one or more processors, the kernel bit in the kernel using the horizontal index and the vertical index.

9. An electronic device, comprising:

a processor that generates and transmits image data;

display control circuitry that receives the image data, and that:

generates and transmits a first sequence of spatial and temporal dithering frames based on the image data, wherein the first sequence of spatial and temporal dithering frames comprises a plurality of spatiotemporal dithering patterns each corresponding to a respective frame period;

wherein the plurality of spatiotemporal dithering patterns are based upon a diamond pattern of red pixels, a diamond pattern of blue pixel, or both formed by a display configured in a diamond pixel configuration; and wherein the display displays the image data.

10. The electronic device of claim 9, wherein the display control circuitry provides error diffusion dithering for the display configured in the diamond pixel configuration.

11. The electronic device of claim 10, wherein the display control circuitry diffuses error in a pixel using a modified Floyd-Steinberg distribution that distributes error of a red pixel to other red pixels in the diamond pixel configuration and spreads error of a blue pixel to other blue pixels in the diamond pixel configuration.

12. The electronic device of claim 10, wherein the display control circuitry comprises logic to selectively bypass provision of the error diffusion dithering.

13. The electronic device of claim 9, wherein the display control circuitry comprises logic to selectively bypass spatiotemporal dithering.

14. The electronic device of claim 9, wherein the display control circuitry:

decompresses pixel data of the image data into a most-significant bit (MSb) portion and a least-significant bit (LSb) portion;

selects a dither kernel from a set of dither kernels based upon the LSb portion;

selects a kernel bit of the dither kernel using a horizontal index and a vertical index; and sets a dithered output to equal the MSb portion plus the kernel bit.

15. The electronic device of claim 14, wherein:

a width of the LSb portion is set to a bit-width difference between a bit-width of the pixel data and a bit-width of the dithered output.

16. The electronic device of claim 14, wherein the plurality of spatiotemporal dithering patterns are based upon selecting the kernel bit from the kernel using only every second pixel for red channels and blue channels.

17. The electronic device of claim 14, wherein the kernel bit is selected at least in part by:

setting the horizontal index equal to (bits [2:1] of an x-coordinate of a pixel data minus bits [2:1] of a y-coordinate of the pixel data) modulo 4;

setting a vertical index equal to (bits [2:1] of the y-coordinate of the pixel data plus bit [0] of the y-coordinate of the pixel data+bits [2:1] of the x-coordinate of the pixel data) modulo 4; and looking up the kernel bit in the kernel using the horizontal index and the vertical index.

18. A tangible, non-transitory, machine-readable medium, comprising machine-readable instructions that, when executed by one or more processors, cause the one or more processors to:

receive an indication of an electronic display panel pixel arrangement, the indication indicating either a non-diamond pattern configuration or a diamond pattern configuration;

implement error diffusion dithering for a plurality of frames of image data, based upon the indication, at least in part by:

when the indication indicates the diamond pattern configuration, diffusing an error of a current pixel to a nearest right pixel with a common sub-color, a nearest bottom-left pixel with the common sub-color, a nearest center-bottom pixel with the common sub-color, and a nearest bottom right pixel with the common sub-color; and otherwise, when the indication indicates the non-diamond pattern configuration, diffusing the error of the current pixel to a right pixel, a bottom-left pixel, a bottom-center pixel, and a bottom right pixel.

19. The tangible, non-transitory, machine-readable medium of claim 18, comprising machine-readable instructions that, when executed by the one or more processors, cause the one or more processors to:

implement spatiotemporal dithering, at least in part by:

receiving a pixel input;

receiving a set of pixel coordinates, comprising an x-coordinate and a y-coordinate associated with the pixel input;

selecting a dithering kernel from a set of dithering kernels, based upon the pixel input;

when the indicator indicates the diamond pattern configuration:

selecting a kernel bit from the kernel, using bits 2:1 of the x-coordinate as a horizontal index and bits 1:0 of the y-coordinate as a vertical index;

otherwise, when the indicator indicates the non-diamond pattern configuration:

selecting the kernel bit from the kernel, using two least-significant bits of the x-coordinate as a horizontal index and two least-significant bits of the y-coordinate as a vertical index; and calculating a dithered output based at least in part upon the kernel bit.

20. The tangible, non-transitory, machine-readable medium of claim 18, comprising machine-readable instructions that, when executed by one or more processors, cause the one or more processors to:

implement spatiotemporal dithering, at least in part by:

receiving a pixel input;

receiving a set of pixel coordinates, comprising an x-coordinate and a y-coordinate associated with the pixel input;

selecting a dithering kernel from a set of dithering kernels, based upon the pixel input;

when the indicator indicates the diamond pattern configuration:

selecting a kernel bit from the kernel, using (bits 2:1 of the x-coordinate of the pixel input minus bits 2:1 of the y-coordinate of the pixel input) modulo 4 as a horizontal index and (bits 2:1 of the y-coordinate of the pixel input plus bit 0 of the y-coordinate of the pixel input plus bits 2:1 of the x-coordinate of the pixel input) modulo 4 as a vertical index;

otherwise, when the indicator indicates the non-diamond pattern configuration:

selecting the kernel bit from the kernel, using two least-significant bits of the x-coordinate as a horizontal index and two least-significant bits of the y-coordinate as a vertical index; and calculating a dithered output based at least in part upon the kernel bit.

* * * * *